US005984701A

United States Patent [19]

Sawayanagi et al.

[11] Patent Number: 5,984,701

[45] Date of Patent: Nov. 16, 1999

[54] LOW INSERTION FORCE CONNECTOR

[75] Inventors: Masahiro Sawayanagi; Nobuyuki Akeda, both of Shizuoka, Japan

[73] Assignee: Yazaki Corporation, Tokyo, Japan

[21] Appl. No.: 09/141,521

[22] Filed: Aug. 27, 1998

[30] Foreign Application Priority Data

Aug. 29, 1997 [JP] Japan ..... 9-234794

[51] Int. Cl.[6] ..... H01R 13/62

[52] U.S. Cl. ..... 439/157; 439/347

[58] Field of Search ..... 439/157, 347

[56] References Cited

U.S. PATENT DOCUMENTS 5,823,807 6/1996 Yamasaki ..... 439/157

FOREIGN PATENT DOCUMENTS 9-17508 1/1997 Japan ..... H01R 13/64

*Primary Examiner*—Neil Abrams
*Assistant Examiner*—Javaid Nasri
*Attorney, Agent, or Firm*—Sughrue, Mion, Zinn, Macpeak & Seas, PLLC

[57] ABSTRACT

A low insertion force connector in which a slider can be firmly provisionally retained on a connector housing. In the low insertion force connector, a slider insertion hole is formed through an outer wall of one connector housing, and a slider has a provisionally-retaining arm and cam grooves, and the other connector housing has follower projections for movement along the cam grooves. A reception surface for the provisionally-retaining arm is formed on the outer wall of the connector housing. A recessed portion is formed at the outer wall, and the slider insertion hole is formed at the recessed portion, and an edge portion of the slider insertion hole, provided in the recessed portion, serves as the reception surface. The provisionally-retaining arm has front and rear projections spaced from each other in a direction of insertion of the slider, and the outer wall is disposed between and engaged with the front and rear projections, and the rear projection is abutted against the reception surface of the outer wall. The front projection has front and rear slanting surfaces, and the rear projection has a front surface, which is substantially perpendicular to the provisionally-retaining arm, and a rear slanting surface.

4 Claims, 9 Drawing Sheets

LOW INSERTION FORCE CONNECTOR

BACKGROUND OF THE INVENTION

1. Field of the Invention

This invention relates to a low insertion force connector in which a slider can be firmly provisionally retained on a connector housing, and by pushing the slider from a provisionally-retained condition, male and female connectors can be fitted together.

2. Description of the Related Art

FIG. 10 shows a conventional low insertion force connector.

This low insertion force connector 61 comprises a female connector 62, a plate-like slider 64 adapted to be inserted into the female connector 61 through a slider insertion hole 63, and a male connector (not shown).

The female connector 62 comprises a female connector housing 65 made of synthetic resin, and male terminals 66. A support post 68 is provided upright at a central portion of a connector fitting chamber 67 of the female connector housing 65, and a slider passage hole 69 is formed through the support post 68. The male terminals 66 are provided in a projected manner on opposite sides of this support post, and the male terminals are connected to wires 70, respectively. This construction is disclosed, for example, in Japanese Patent Unexamined Publication No. Hei. 9-17508.

The slider 64 is made of synthetic resin, and includes a flexible, provisionally-retaining arm 71 for the support post 68, and a cam groove 72 for guiding a follower projection of the male connector (not shown). The provisionally-retaining arm 71 serves as a stopper.

As shown in FIG. 11, the slider 64 is inserted into the female connector housing 65, and a distal end portion of the slider 64 is passed through the passage hole 69 in the support post 68, with a distal end of the provisionally-retaining arm 71 abutted against the support post 68, and in this condition the slider 64 is provisionally retained. Then, the male connector is initially inserted into the female connector 62, and when the slider 64 is pushed, the provisionally-retained condition is canceled, and the follower projection of the male connector is guided along the cam groove 72 (see FIG. 10) in the slider 64, so that the male connector is moved in a connector fitting direction, and the male and female connectors are fitted together.

In the above conventional construction, however, when the slider 64 was pushed from the provisionally-retained condition shown in FIG. 11, a large force acted on the support post 68, so that the support post 68 was often deformed or damaged. This problem was also encountered when an external force was applied to the slider 64, for example, during the transport of the female connector 62 having the slider 64 held in the provisionally-retained condition.

SUMMARY OF THE INVENTION

With the above problem in view, it is an object of this invention to provide a low insertion force connector in which a slider can be positively and smoothly moved into a provisionally-retained condition, and can be pushed from the provisionally-retained condition without deforming or damaging a connector housing including a support post.

In order to achieve the above object, according to the present invention, there is provided a low insertion force connector comprising: a first connector housing having a slider insertion hole formed through an outer wall thereof; a slider having a provisionally-retaining arm and a cam groove; and a second connector housing having a follower projection for movement along the cam groove, wherein a reception surface for the provisionally-retaining arm is formed on the outer wall of the first connector housing.

DETAILED DESCRIPTION OF THE PREFERRED EMBODIMENT

A preferred embodiment of the present invention will now be described in detail with reference to the drawings.

Figure 1:
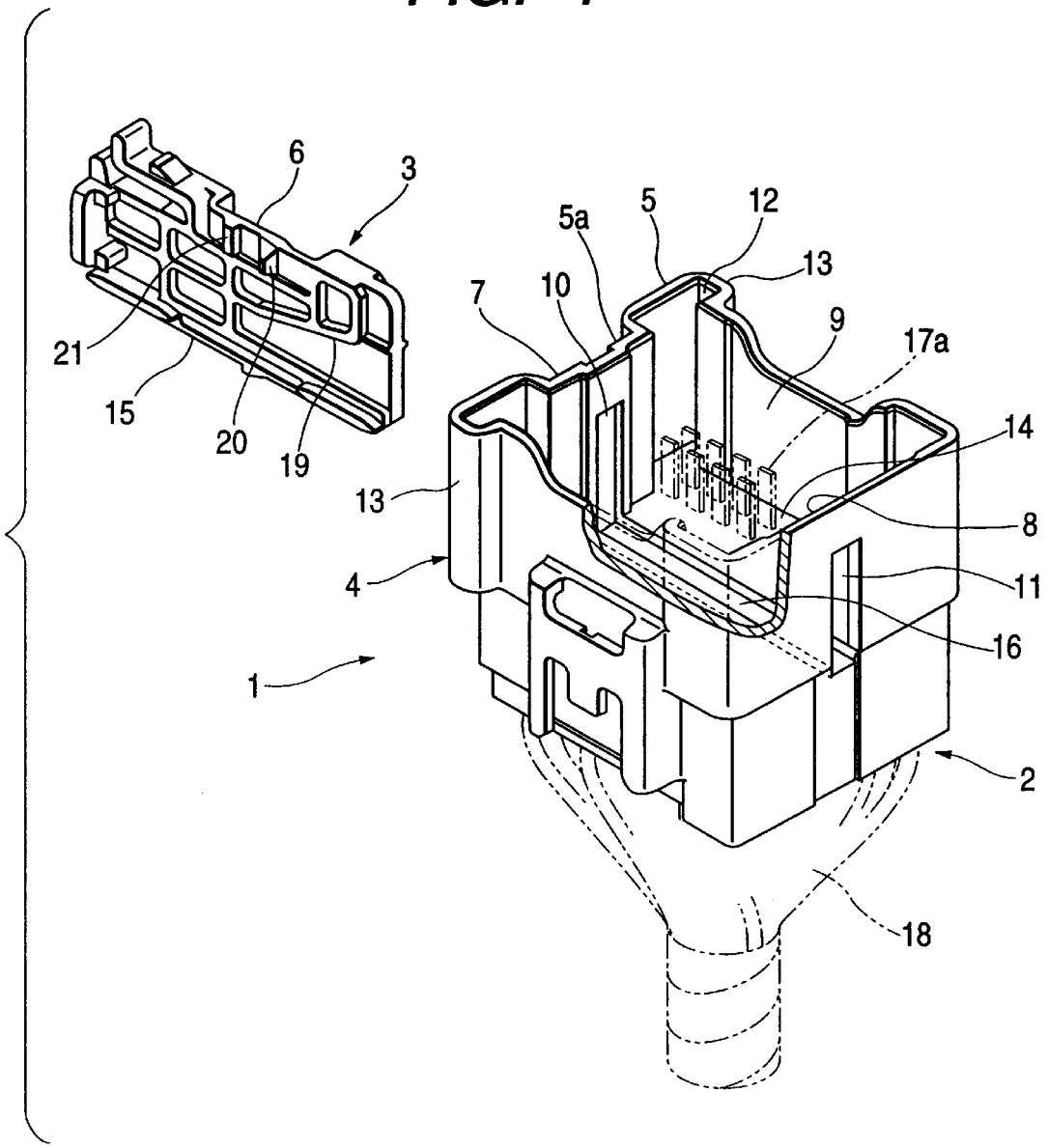
FIG. 1 is an exploded, perspective view of a low insertion force connector of the present invention.
Figure 2:
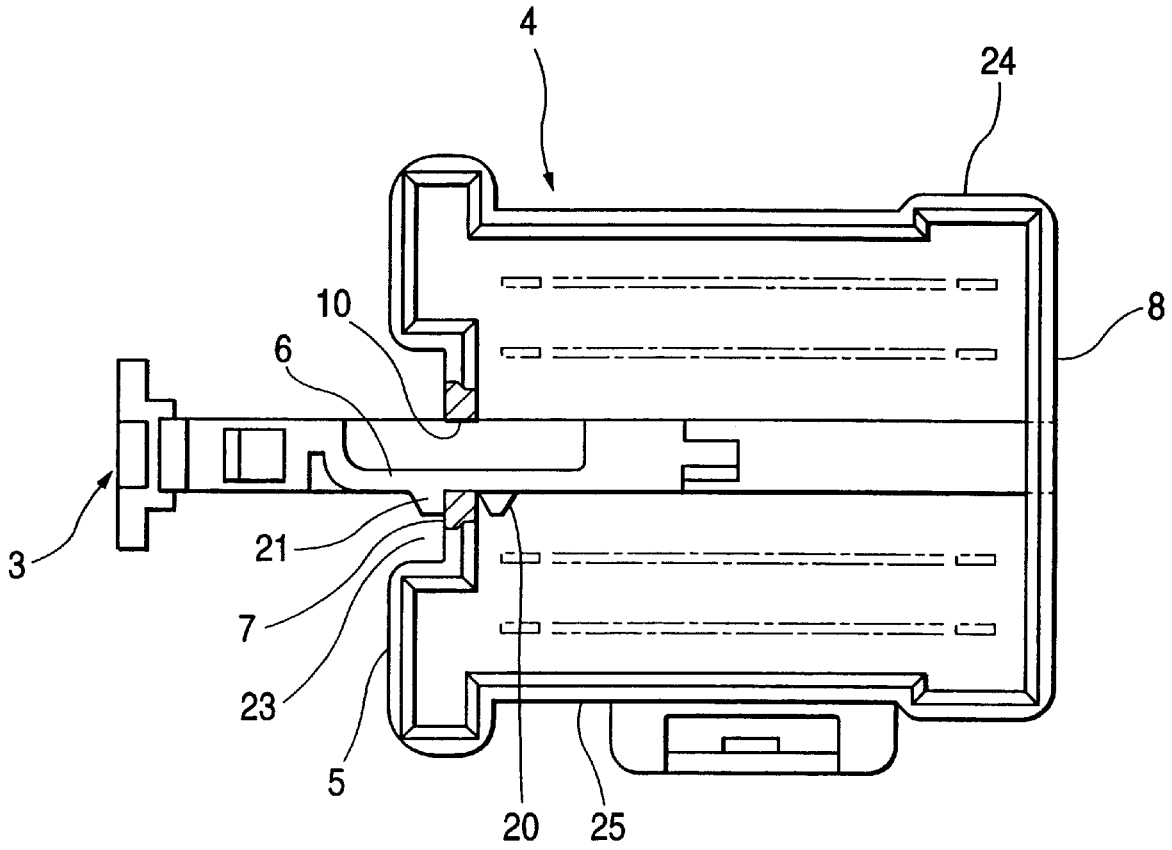
FIG. 2 is a partly cross-sectional, plan view of the connector, showing a slider held in a provisionally-retained condition.

FIGS. 1 and 2 show a general construction of a low insertion force connector of the present invention.

As shown in FIG. 1, this low insertion force connector 1 comprises a female connector 2, a plate-like slider 3 for insertion into the female connector 2 in a direction perpendicular to a connector fitting direction, and a male connector (not shown) which is fitted into the female connector 2 by pushing the slider 3. A feature of the invention is that a reception portion (reception surface) 7 for a provisionally-retaining arm 6 of the slider 3 is formed on a side wall (outer wall) 5 of a female connector housing 4 made of synthetic resin.

Slider insertion holes 10 and 11 each in the form of a rectangular slit are formed respectively through the opposite side walls 5 and 8 of the female connector housing 4, and communicate with a connector fitting chamber 9. The side wall 5 is recessed at a central portion thereof, and the slider insertion hole 10 is formed through a central portion of this recessed portion 5*a*. A side edge portion of the slider insertion hole 10 serves as the reception portion 7 for the provisionally-retaining arm 6.

A pair of guide engagement portions 13 are formed in a bulged manner on opposite sides of the recessed portion 5*a*, and each guide engagement portion 13 has a guide groove 12 extending in the connector fitting direction so as to receive a corresponding elongate positioning projection of a male connector housing. A guide groove 16 for guiding a bottom portion 15 of the slider 3 is formed in a bottom wall 14 of the connector fitting chamber 9, and this guide groove 16 is continuous with the slider insertion holes 10 and 11. Male tab portions (distal end portions) 17*a* of male terminals are disposed in a projected manner on opposite sides of the guide groove 16. The male terminals are connected to wires 18, respectively. The female connector housing 4 and the male terminals jointly constitute the female connector 2.

The slider 3 is made of synthetic resin, and has the provisionally-retaining arm 6 provided at an intermediate portion thereof in a longitudinal direction thereof, and also has cam grooves 19 provided below the provisionally-retaining arm 6 so as to respectively guide follower projections of the male connector (not shown). The provisionally-retaining arm 6 is supported at its opposite ends on the slider 3, and has a pair of front and rear projections 20 and 21. The provisionally-retaining arm can, of course, be of the cantilever type.

As shown in FIG. 2, when the slider 3 is inserted into the female connector housing 4 through the slider insertion hole 10, the provisionally-retaining arm 6 engages the side wall 5 (the recessed portion 5*a*) of the female connector housing 4. More specifically, the front projection 20 of the provisionally-retaining arm 6 passes through the side wall 5 while the rear projection 21 abuts against the outer surface (reception surface 7 ) of the side wall 5. As a result, the slider 3 is provisionally retained. The rear projection 21 is disposed in a space 23 defined by the recessed portion 5*a,* and is protected from external interference, thereby preventing the accidental cancellation of the provisionally-retained condition.

When the slider 3 is provisionally retained, the slider 3 is received by one (side wall 5) of the four side walls 5, 8, 24 and 25 of the female connector housing 4 connected together to form a substantially rectangular configuration, and therefore this is advantageous from the viewpoint of the strength, and even if an external force is applied to the slider 3 in the provisionally-retained condition, the wall 5 will not be deformed or damaged in contrast with the support post of the conventional construction.

Particularly, the recessed portion 5*a* is formed at the central portion of the wall 5, and therefore the wall 5 is higher in rigidity than the flat side wall 8 facing the wall 5, and since the slider insertion hole 10 is formed through the central portion of this recessed portion 5*a,* the strength for receiving the provisionally-retaining arm 6 of the slider 3 is considerably high. Examples of external forces to be applied to the slider 3 include a force in the direction of insertion of the slider, and a force tending to forcibly turn the slider 3 in directions substantially perpendicular to the axis of the slider 3, and the wall 5 exhibits a sufficient strength to receive (or withstand) such external force. Therefore, the provisionally-retaining force for the slider 3 is increased.

FIGS. 3 to 9 show an example of detailed construction of the above low insertion force connector. The portions identical to those of the above embodiment will be designated by identical reference numerals, respectively, and detailed explanation thereof will be omitted.

Figure 3:
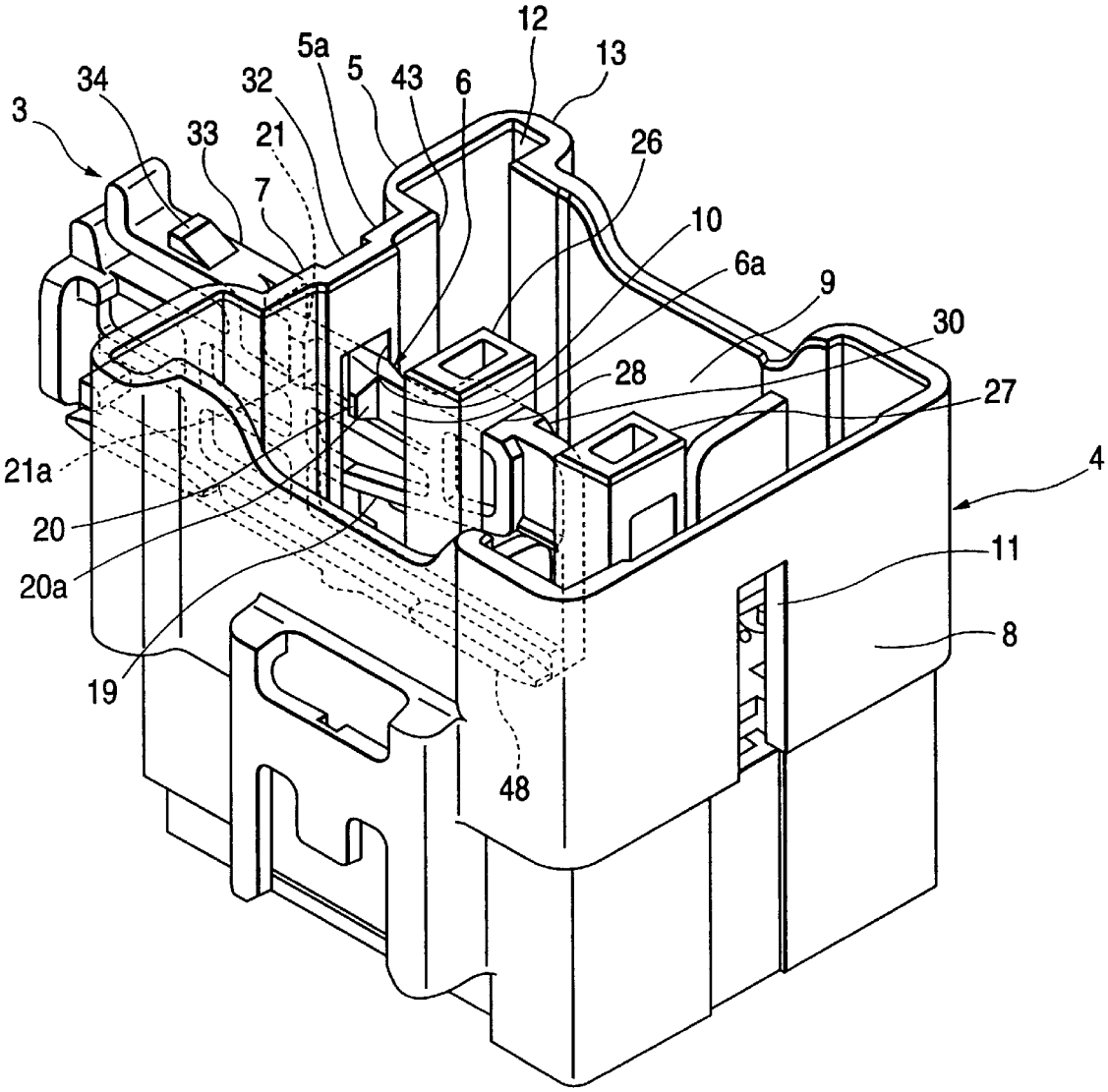
FIG. 3 is a perspective view showing a detailed construction of the low insertion force connector, showing the slider held in the provisionally-retained condition.
Figure 4:
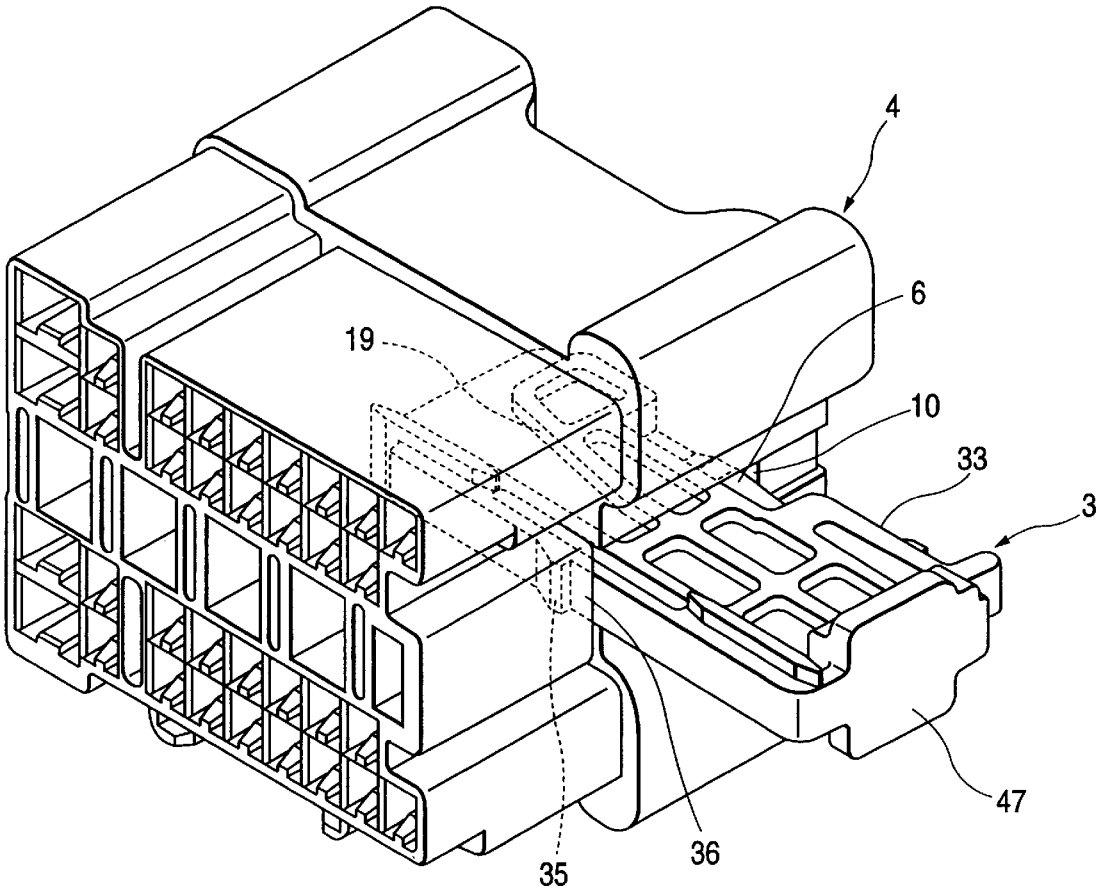
FIG. 4 is a view showing the detailed construction in a different direction.

FIGS. 3 and 4 show, in different directions, a condition in which the slider 3 is provisionally retained on the female connector housing 4.

In FIG. 3, a pair of support posts 26 and 27 each in the form of a rectangular tube are provided upright within the connector fitting chamber 9 of the female connector housing 4, and slider passage holes 28 and 29 each in the form of a rectangular slit are formed through the support posts 26 and 27, respectively. The slider passage holes 28 and 29 are equal in shape and size to the slider insertion holes 10 and 11 formed respectively through the opposite side walls 5 and 8. The slider 3 is guided through the slider passage holes 28 and 29 formed respectively through the support posts 26 and 27. In the provisionally-retained condition of the slider 3, a distal end portion 30 of the slider 3 is passed through the first support post 26.

The provisionally-retaining arm 6 of the slider 3 is passed through and engaged in the slider insertion hole 10 in the side wall 5 of the female connector housing 4. The front (in the inserting direction) projection 20 (see FIG. 6) has a slanting surface 20*a* for sliding contact with the edge portion 7 (FIG. 5) of the slider insertion hole 10, and therefore can be easily passed through the slider insertion hole 10. The rear projection 21 has a front retaining surface 21*a* extending substantially perpendicularly from a provisionally-retaining arm body 6*a,* and this retaining surface 21*a* abuts against the edge portion (reception surface) 7 of the slider insertion hole 10, thereby effecting the positive retaining operation. The retaining surface 21*a* serves as a stopper of the slider 3. A groove portion 31 (FIG. 6) between the front and rear projections 20 and 21 is engaged with the side wall 5.

Figure 5:
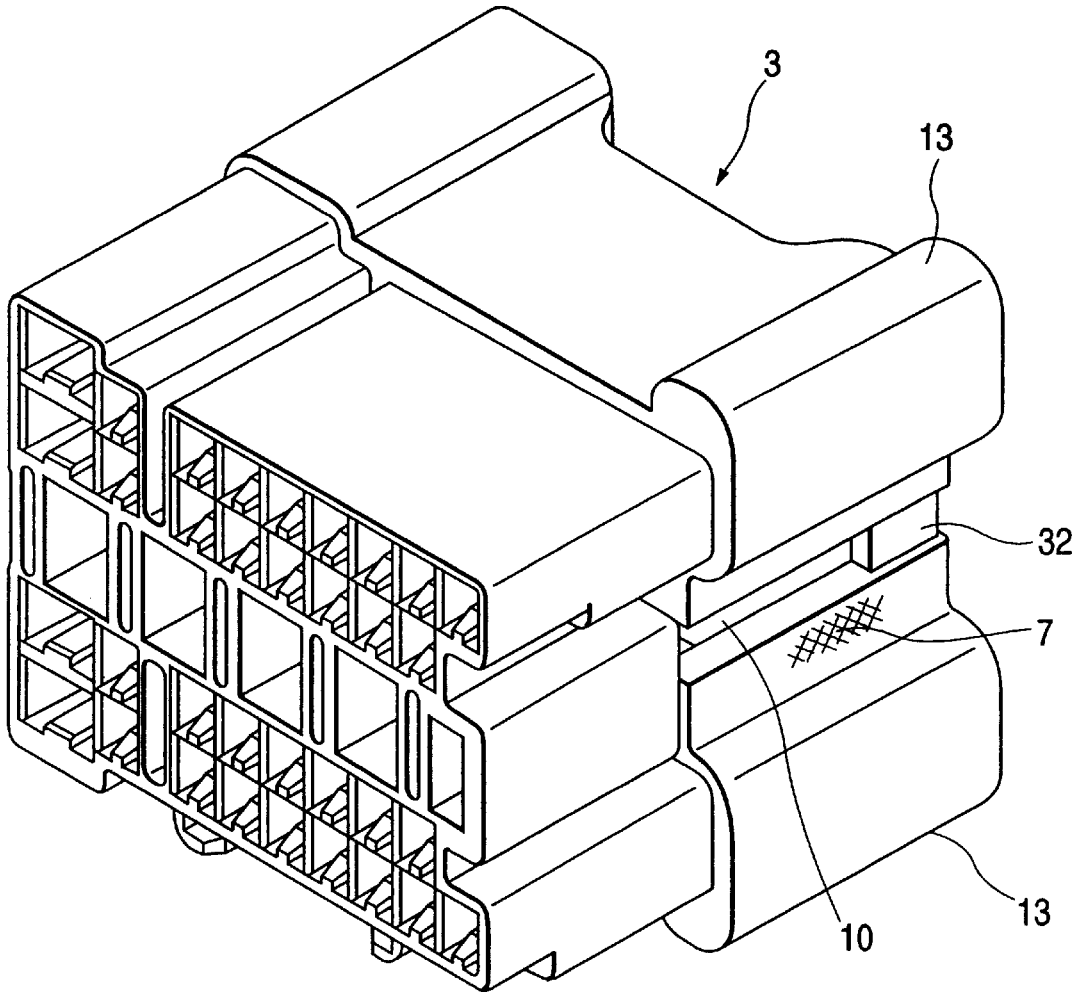
FIG. 5 is a perspective view of a female connector housing.

As indicated by hatching in FIG. 5, the reception surface 7 of the female connector housing 4, which receives the retaining surface 21*a* of the projection 21, is provided at an upper portion of one edge portion of the slider insertion hole 10, and is flat. A relatively thin, interconnecting wall 32 is formed at an upper end of the slider insertion hole 10, and a projection 34 of a completely-retaining arm 33 (FIG. 3), formed at a rear portion of the slider 3, can pass the interconnecting wall 32 to be engaged therewith. As shown in FIG. 3, the peripheral edge portion of the slider insertion hole 10 is thickened by the provision of step portions 43 at the inner side of the interconnecting wall 32, and with this construction the reception surface (outer surface) 7 is increased in rigidity.

Figure 6:
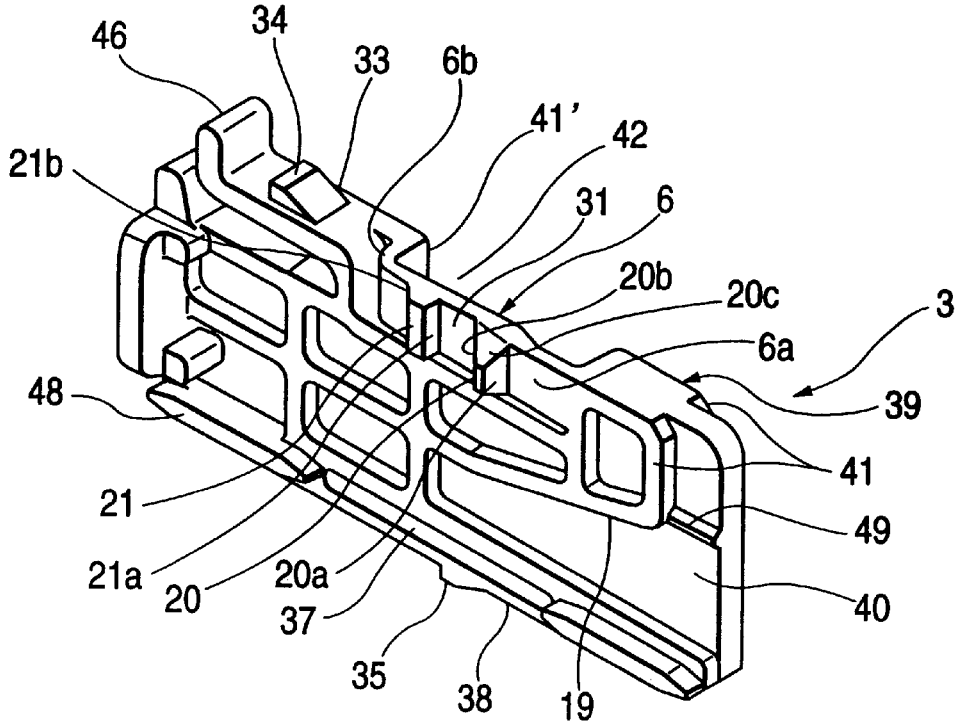
FIG. 6 is a perspective view of the slider.

A projection 35, formed on the lower portion of the slider 3, passes a wall 36 disposed at the lower side of the slider insertion hole 10, and is engaged therewith in the provisionally-retained condition of the slider 3, as shown in FIG. 4. As shown in FIG. 6, this projection 35 is formed on a flexible wall 38, and a flexure space 37 is provided at the upper side of this elastic wall 38.

Figure 7:
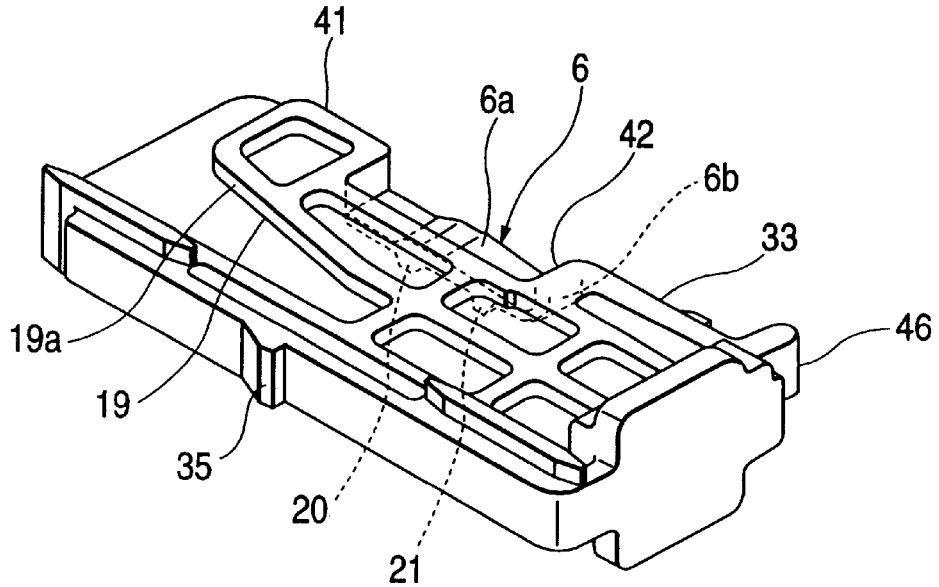
FIG. 7 is a perspective view showing the slider in a different direction.

As shown in FIGS. 6 and 7 which show only the slider 3, the provisionally-retaining arm 6 is disposed at the upper portion of the intermediate portion of the slider 3 in the longitudinal direction thereof. The opposite (front and rear) ends of the provisionally-retaining arm 6 are continuous with a body 39 of the slider, and therefore this arm 6 is supported at its opposite ends on the slider body 39. Convex walls 41 are formed respectively on opposite sides of a thin wall 40 defining a front half portion of the slider 3, and the cam grooves 19 are formed respectively at the opposite sides of the thin wall 40, and each cam groove 19 has a slanting guide surface 19*a* (FIG. 7) provided at the boundary between the convex wall 41 and the thin wall 40. The follower projections 45 of the male connector housing 44 (FIG. 8) are guided along the cam grooves 19, respectively.

The provisionally-retaining arm 6 is disposed in a plane in which the convex wall 41 on one side of the thin wall 40 is disposed, and the front and rear projections 20 and 21 project outwardly beyond the convex wall 41, and a rear end portion 6*b* of the arm 6 is curved substantially perpendicularly, and is continuous with a convex wall 41' formed on the other side of the thin wall 40. The provisionally-retaining arm 6 is considerably recessed to provide a flexure space 42 formed between the convex walls 41 and 41' on the other side of the thin wall 40. The flexed arm body 6*a,* as well as the projections 20 and 21, is completely received in this flexure space 42.

The front projection 20 has the front slanting surface 20*a* and a rear slanting surface 20*b,* and therefore the front projection 20 can easily pass through the slider insertion hole 10 (FIG. 3) when the slider 3 is inserted into and removed from the female connector housing. The area of contact of each of the slanting surfaces 20*a* and 20*b* is reduced because of the provision of an upper slanting surface 20*c,* thereby enabling the front projection 20 to more smoothly pass through the slider insertion hole 10. The rear projection 21 has the front retaining surface 21*a,* which is substantially perpendicular to the arm body 6*a,* and a rear slanting surface 21*b,* and the rear projection 21 is positively retained by the edge portion 7 of the slider insertion hole 10 when the slider 3 is inserted into the female connector housing, and also the rear projection 21 can smoothly pass through the slider insertion hole 10 when removing the slider.

The completely-retaining arm 33 is provided rearwardly of the provisionally-retaining arm 6. By depressing an operation projection 46, the completely-retained condition can be canceled. A flange-like press operation portion 47 is provided rearwardly of the completely-retaining arm 33, that is, at the rear end of the slider 3, and elongate slide projections 48 for the female connector housing 4 (FIG. 4) are formed respectively on the opposite sides of the slider 3 at the lower portion thereof. Guide grooves (not shown) for respectively guiding the elongate guide projections 48 are formed in the female connector housing 4 (FIG. 3). In FIG. 6, reference numeral 49 designates an inertia insertion abutment projection for the follower projection 45 of the male connector housing 44 (FIG. 8).

Figure 8:
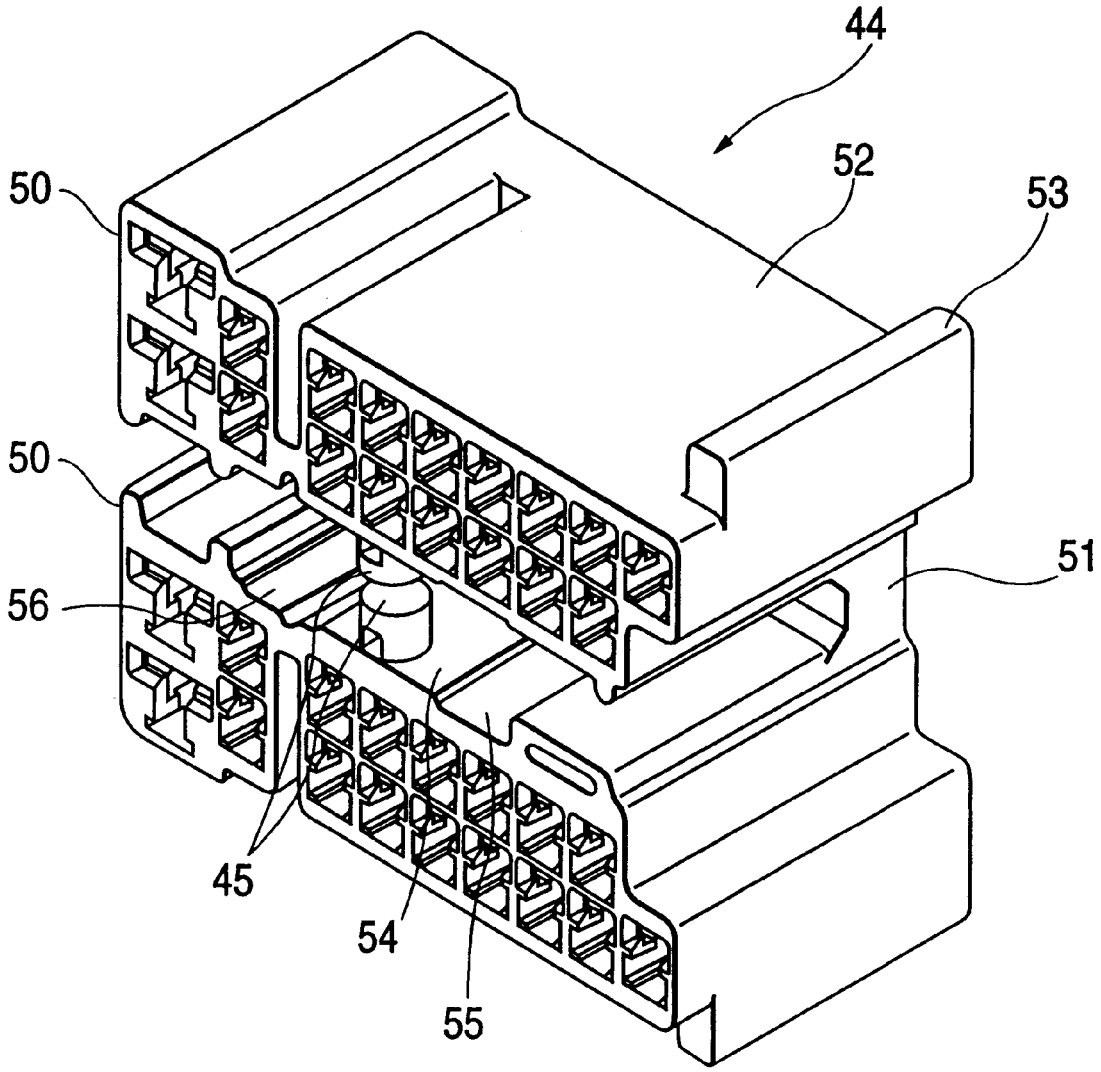
FIG. 8 is a perspective view of a male connector housing.

As shown in FIG. 8, the male connector housing 44 comprises a pair of terminal insertion blocks 50 and 50, and an interconnecting portion interconnecting these blocks. Elongate positioning projections 53 for insertion into the guide grooves 12 in the female connector housing 4 (FIG. 3) are formed respectively on outer walls 52 of the terminal insertion blocks 50. The pair of follower projections 45 are formed respectively on inner walls 54 of the terminal insertion blocks 50 in opposed relation to each other, and insertion guide grooves 55 and 56 for respectively guiding the pair of support posts 26 and 27 of the female connector housing 4 (FIG. 3) are formed in the inner wall 54 of each of the blocks 50.

Figure 9:
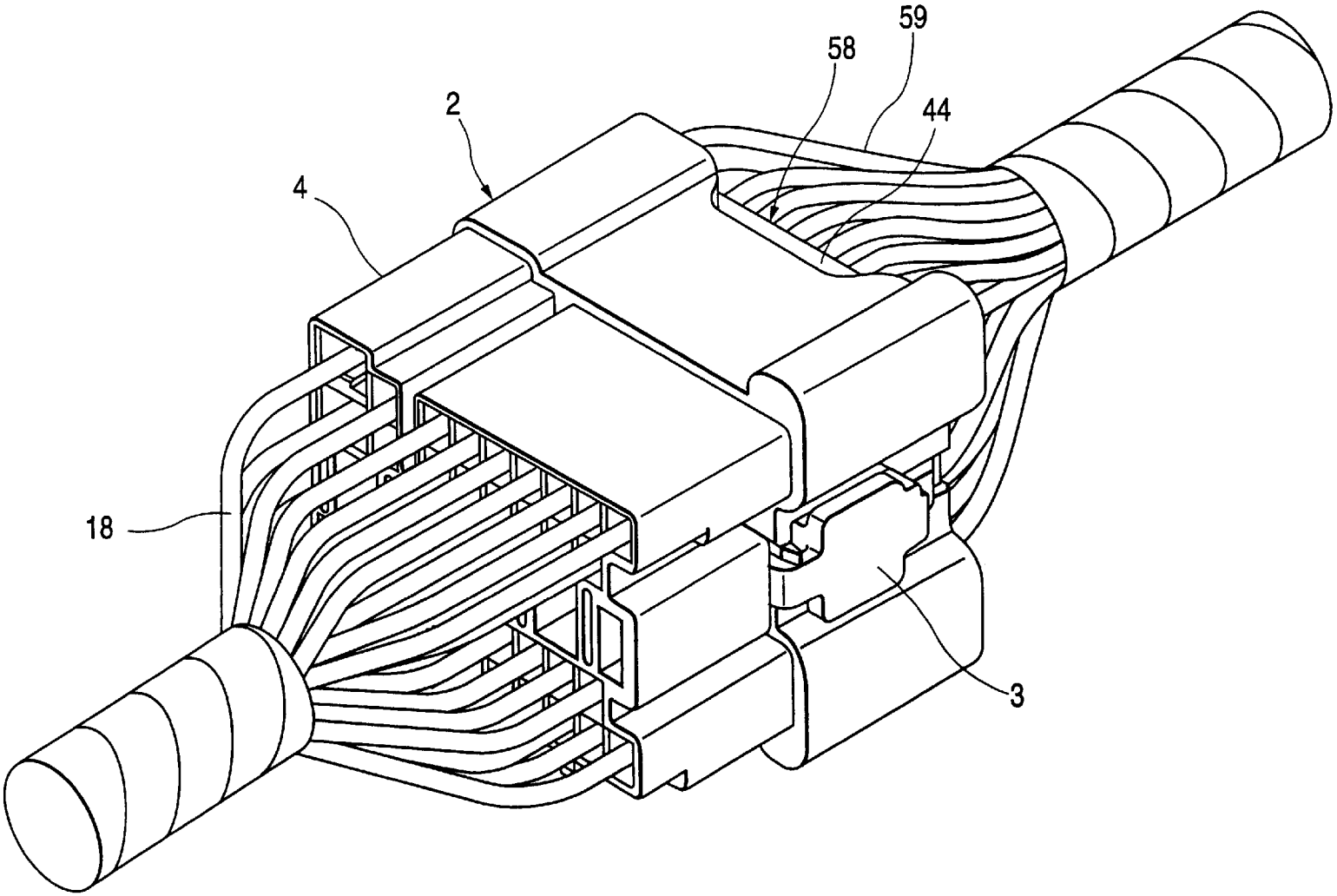
FIG. 9 is a perspective view showing the male and female connectors completely fitted together.
Figure 10:
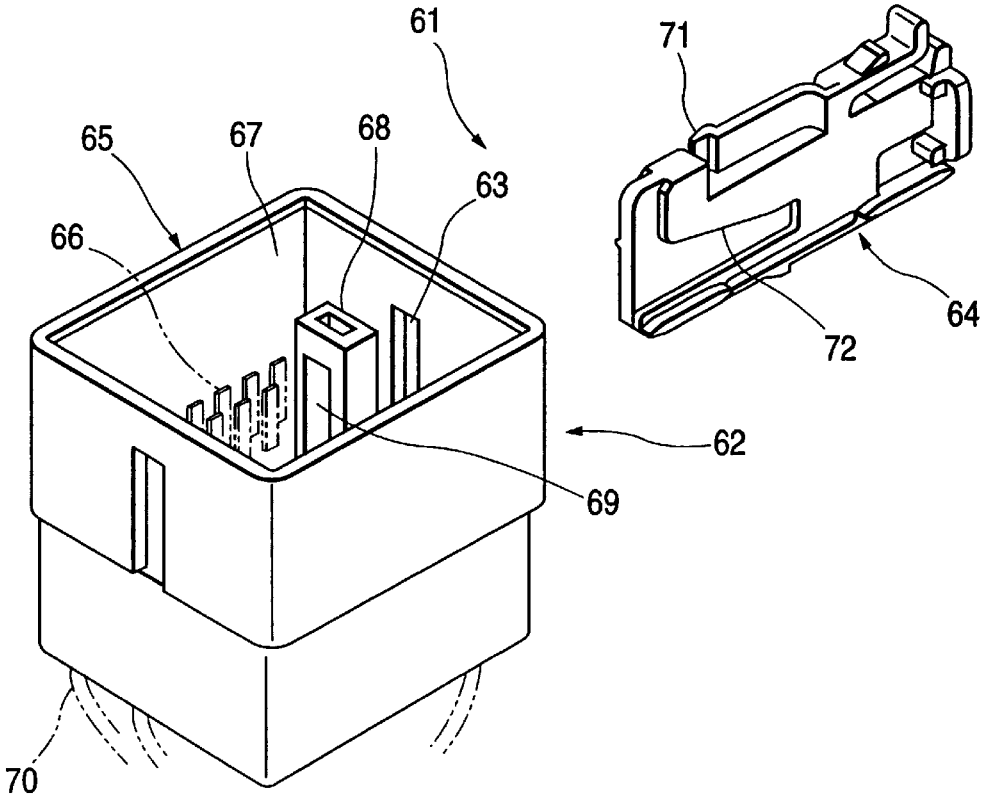
FIG. 10 PRIOR ART
FIG. 10 is an exploded, perspective view of a conventional construction.
Figure 11:
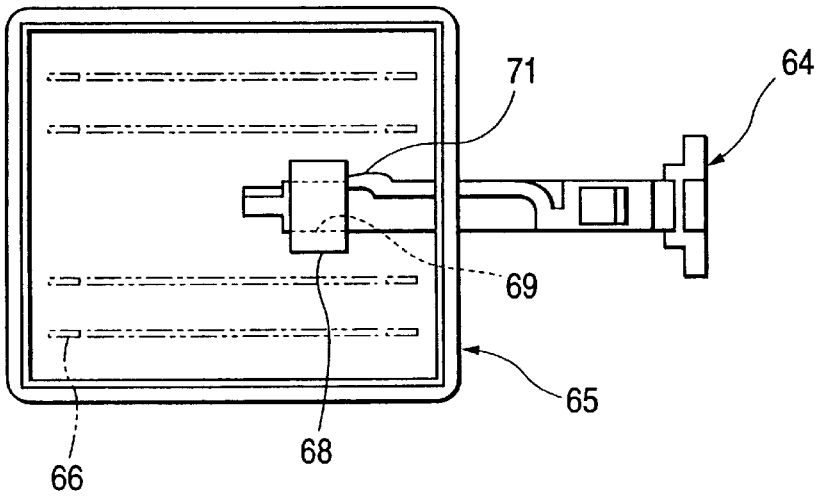
FIG. 11 PRIOR ART
FIG. 11 is a plan view showing the conventional construction, showing a slider held in a provisionally-retained condition.

FIG. 9 shows the male and female connectors 58 and 2 fitted together. The terminals, connected respectively to wires 59, are inserted into the male connector housing 44, and the terminals, connected respectively to the wires 18, are inserted into the female connector housing 4, and the slider 3 is provisionally retained as shown in FIG. 3, and in this condition the male and female connectors 58 and 2 are initially fitted together by the inertia insertion, and then the slider 3 is pushed, thereby guiding the follower projections 45 (FIG. 8) respectively along the cam grooves 19 (FIG. 3), so that the follower projections 45 are moved in the connector fitting direction, and as a result the two connectors 58 and 2 are completely fitted together with a low force.

As described above, in the invention, in the provisionally-retained condition of the slider, the provisionally-retaining arm of the slider is abutted against the rigid outer wall of the connector housing, and therefore even if an external force is applied to the slider, the outer wall will not be deformed or damaged, and besides the provisionally-retaining force for the slider is increased, and the provisional retaining of the slider, as well as the cancellation of the provisionally-retained condition by the pushing of the slider, can be effected positively and smoothly.

What is claimed is:

1. A low insertion force connector comprising:

a first connector housing having a slider insertion hole formed through an outer wall thereof;

a slider having a provisionally-retaining arm and a cam groove, said provisionally-retaining arm retaining said slider in a partially inserted position in said slider insertion hole; and a second connector housing having a follower projection for movement along the cam groove, wherein a reception surface is formed on the outer wall of said first connector housing, said reception surface being engaged by said provisionally-retaining arm to hold said slider in said partially inserted position.

2. The low insertion force connector according to claim 1, wherein a recessed portion is formed at the outer wall of said first connector housing, the slider insertion hole is formed at the recessed portion, and an edge portion of the slider insertion hole serves as the reception surface.

3. The low insertion force connector according to claim 1, wherein the provisionally-retaining arm of said slider includes front and rear projections spaced from each other in a direction of insertion of said slider, the outer wall of said first connector housing is disposed between and engaged with the front and rear projections when said slider is in said partially inserted position, and the rear projection is abutted against the reception surface of the outer wall.

4. The low insertion force connector according to claim 3, wherein the front projection has front and rear slanting surfaces, and the rear projection has a front surface, which is substantially perpendicular to the provisionally-retaining arm, and a rear slanting surface.

* * * * *